United States Patent [19]

Fujimori

[11] Patent Number: 4,984,495

[45] Date of Patent: Jan. 15, 1991

[54] MUSICAL TONE SIGNAL GENERATING APPARATUS

[75] Inventor: Junichi Fujimori, Hamamatsu, Japan

[73] Assignee: Yamaha Corporation, Hamamatsu, Japan

[21] Appl. No.: 350,107

[22] Filed: May 9, 1989

[30] Foreign Application Priority Data

May 10, 1988 [JP] Japan ..... 63-112891

[51] Int. Cl.[5] ..... G10H 1/02; G10H 7/00

[52] U.S. Cl. ..... 84/603; 84/604; 84/630; 84/DIG. 26

[58] Field of Search ..... 84/603-607, 84/630, 662, 707, 737, DIG. 26

[56] References Cited

U.S. PATENT DOCUMENTS

| | | | |
|---|---|---|---|
| 3,740,450 | 6/1973 | Dentsch | 84/603 X |
| 3,821,714 | 6/1974 | Tomisawa et al. | 84/604 X |
| 4,200,021 | 4/1980 | Chibana | 84/604 |
| 4,373,416 | 2/1983 | Endo et al. | 84/604 |
| 4,476,765 | 10/1984 | Hentzschel et al. | 84/604 |
| 4,679,480 | 7/1987 | Suzuki | 84/604 |
| 4,706,291 | 11/1987 | Kakubo et al. | 84/DIG. 26 X |
| 4,715,257 | 12/1987 | Hoshiai et al. | 84/603 |
| 4,803,731 | 2/1989 | Niimi et al. | 84/DIG. 26 X |
| 4,864,625 | 9/1989 | Hanzawa et al. | 84/603 X |
| 4,882,963 | 11/1989 | Ichiki | 84/603 |

*Primary Examiner*—W. B. Perkey

*Attorney, Agent, or Firm*—Spensley Horn Jubas & Lubitz

[57] ABSTRACT

In a musical tone signal generating apparatus, first sampling data and second sampling data are multiplied together by a convolution operation, wherein first sampling data indicates instantaneous amplitude values of a musical tone waveform generated from a keyboard, for example. The second sampling data is obtained from an impulse response waveform signal indicative of a reverberation characteristic of room or an acoustic characteristic of amplifier or musical instrument such as a guitar or a piano. Or, the second sampling data can be obtained from a waveform signal indicative of animal sound, natural sound or the like. Then, the multiplication result of first and second sampling data is combined together into the musical tone waveform data, whereby a musical tone signal corresponding to this musical tone waveform data is generated. Thus, the musical tone is modulated with another sound such that the reverberation or acoustic characteristic will be simulated in the musical tone to be generated, whereby the variable musical effect can be applied to the musical tone.

9 Claims, 8 Drawing Sheets

MUSICAL TONE SIGNAL GENERATING APPARATUS

BACKGROUND OF THE INVENTION

1. Field of the Invention

The present invention relates to a musical tone signal generating apparatus which can be used for an electronic musical instrument, toys and the like, and more particularly to a musical tone signal generating apparatus in which a waveform signal is modulated such that a desirable musical effect will be applied to a musical tone to be generated or so that the modulated waveform signals are combined together into a new musical tone signal.

2. Prior Art

It is well known that the conventional apparatus modulates the musical tone signal with the waveform signal having a low frequency in an amplitude modulation, phase modulation, frequency modulation or the like, so that the musical effect such as a tremolo, ensemble and the like can be obtained. Or, this conventional apparatus circulatingly delays the musical tone signal such that the reverberation effect or echo effect can be obtained.

However, in the above-mentioned conventional apparatus, the modulation or delay is monotonous so that the musical tone to be generated must be short of the massiveness, thickness or depth in the music (hereinafter, referred to as a musical thickness). Therefore, the listener may feel unsatisfied with such musical tone.

SUMMARY OF THE INVENTION

It is accordingly a primary object of the present invention to provide a musical tone signal generating apparatus capable of applying the variable musical effect or the musical thickness to the musical tone to be generated.

In a first aspect of the present invention, there is provided a musical tone signal generating apparatus comprising:

(a) means for sequentially generating musical tone waveform data in lapse of time, the musical tone waveform data consisting of first sampling data indicative of instantaneous amplitude values of a continuous musical tone waveform;

(b) first storing means for delaying the first sampling data outputted from the means, so that the storing means sequentially stores delayed first sampling data therein;

(c) acoustic converting means for converting an acoustic signal into an analog signal, wherein the acoustic signal indicates acoustics of an externally picked-up musical tone;

(d) analog-to-digital converting means for sequentially converting instantaneous values of the analog signal into a digital signal by every predetermined time;

(e) second storing means for sequentially storing the digital signal as second sampling data indicative of the externally picked-up musical tone;

(f) multiplying means for multiplying each of the delayed first sampling data and each of the second sampling data together; and (g) combining means for combining output data of the multiplying means together to thereby form an output musical tone waveform, the output musical tone waveform being outputted from the combining means as output sampling data indicative of instantaneous amplitude values thereof.

In a second aspect of the present invention, there is provided a musical tone signal generating apparatus comprising:

(a) first means for sequentially generating first sampling data indicative of instantaneous amplitude values of a first continuous musical tone waveform in lapse of time;

(b) first storing means for delaying the first sampling data outputted from the first means, so that the first storing means sequentially stores delayed first sampling data therein;

(c) second means for sequentially generating second sampling data indicative of instantaneous values of a second continuous musical tone waveform;

(d) second storing means for delaying the second sampling data outputted from the second means, so that the second storing means sequentially stores delayed second sampling data therein;

(e) multiplying means for multiplying each of the delayed first sampling data and each of the delayed second sampling data together; and (f) combining means for combining output data of the multiplying means together to thereby form an output musical tone waveform, the output musical tone waveform being outputted from the combining means as output sampling data indicative of instantaneous amplitude values thereof.

In a third aspect of the present invention, there is provided a musical tone signal generating apparatus comprising:

(a) first means for sequentially generating first sampling data indicative of instantaneous amplitude values of a continuous musical tone waveform in lapse of time;

(b) first storing means for delaying the first sampling data outputted from the first means, so that the first storing means sequentially stores delayed first sampling data therein;

(c) acoustic converting means for converting an acoustic signal into an analog signal, wherein the acoustic signal indicates acoustics of an externally picked-up musical tone;

(d) analog-to-digital converting means for sequentially converting instantaneous values of the analog signal into a digital signal by every predetermined time, the digital signal being outputted as second sampling data;

(e) second storing means for delaying the second sampling data, so that the second storing means sequentially stores delayed second sampling data therein;

(f) multiplying means for multiplying each of the delayed first sampling data and each of the delayed second sampling data together; and (g) combining means for combining output data of the multiplying means together to thereby form an output musical tone waveform, the output musical tone waveform being outputted from the combining means as output sampling data indicative of instantaneous amplitude values thereof.

In a fourth aspect of the present invention, there is provided a musical tone signal generating apparatus comprising:

(a) means for sequentially generating musical tone waveform data in lapse of time, the musical tone waveform data consisting of first sampling data indicative of instantaneous amplitude values of a continuous musical tone waveform;

(b) storing means for delaying the first sampling data outputted from the means, so that the storing means sequentially stores delayed first sampling data therein;

(c) waveform storing means for storing second sampling data indicative of instantaneous amplitude values of another musical tone waveform;

(d) multiplying means for multiplying each of the delayed first sampling data and each of the second sampling data together; and (e) combining means for combining output data of the multiplying means together to thereby form an output musical tone waveform, the output musical tone waveform being outputted from the combining means as output sampling data indicative of instantaneous amplitude values thereof.

In a fifth aspect of the present invention, there is provided musical tone signal generating apparatus comprising:

(a) means for generating musical tone waveform data in lapse of time, the musical tone waveform data consisting of first sampling data indicative of instantaneous amplitude values of a continuous musical tone waveform;

(b) storing means for delaying the first sampling data outputted from the means, so that the storing means stores delayed first sampling data therein;

(c) waveform storing means for storing second sampling data indicative of instantaneous amplitude values of another musical tone waveform;

(d) operating means for operating each of the delayed first sampling data and each of the second sampling data together; and (e) tone forming means for forming a musical tone signal based on an output of the operating means.

In a sixth aspect of the present invention, there is provided a musical tone signal generating apparatus comprising:

(a) first means for sequentially generating first sampling data indicative of instantaneous amplitude values of a first continuous musical tone waveform in lapse of time;

(b) second means for sequentially generating second sampling data indicative of instantaneous values of a second continuous musical tone waveform;

(c) operating means for operating each of the delayed first sampling data and each of the delayed second sampling data together; and (d) tone forming means for forming a musical tone signal based on an output of the operating means.

BRIEF DESCRIPTION OF THE DRAWINGS

Further objects and advantages of the present invention will be apparent from the following description, reference being had to the accompanying drawings wherein a preferred embodiment of the present invention is clearly shown.

DESCRIPTION OF A PREFERRED EMBODIMENT

Figure 1:
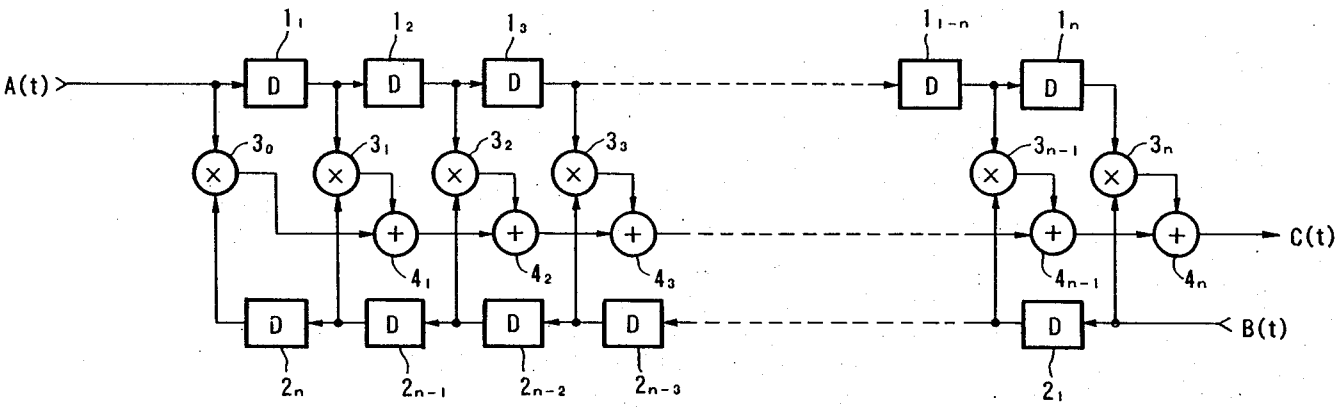
FIG. 1 is a circuit diagram showing a basic configuration for a convolution operation control according to the present invention.

Next, description will be given to a preferred embodiment of the present invention by referring to the drawings wherein like reference characters are designated by like or corresponding numerals in the several views.

[A] BASIC CONFIGURATION FOR CONVOLUTION OPERATION CONTROL

First, description will be given with respect to the convolution operation control which is used for an embodiment of the present invention.

FIG. 1 is a circuit diagram showing the electric circuit which is used as the convolution operation control. This circuit shown in FIG. 1 consists of n-stage circuits which include n pairs of delay circuits $\mathbf{1}_1, \mathbf{1}_2, \ldots, \mathbf{1}_n$ and $\mathbf{2}_1, \mathbf{2}_2, \ldots, \mathbf{2}_n$, (n+1) multipliers $\mathbf{3}_0, \mathbf{3}_1, \mathbf{3}_2, \ldots, \mathbf{3}_n$, and n adders $\mathbf{4}_1, \mathbf{4}_2, \ldots, \mathbf{4}_n$.

The delay circuit $\mathbf{1}_1$ inputs sampling data A(t) indicative of an instantaneous value of a first continuous waveform signal which is taken by every delay time dt (where d means delta Δ). Each of the delay circuits $\mathbf{1}_1, \mathbf{1}_2, \ldots, \mathbf{1}_n$ delays its input signal by the delay time dt, whereby these delay circuits $\mathbf{1}_1, \mathbf{1}_2, \ldots, \mathbf{1}_n$ output sampling data A(t-dt), A(t-2dt), . . . , A(t-ndt) respectively. Another delay circuit $\mathbf{2}_1$ inputs sampling data B(t) indicative of an instantaneous value of a second continuous waveform signal which is taken by every delay time dt. Each of the delay circuits $\mathbf{2}_1, \mathbf{2}_2, \ldots, \mathbf{2}_n$ delays its input signal by the delay time dt, whereby these delay circuits $\mathbf{2}_1, \mathbf{2}_2, \ldots, \mathbf{2}_n$ output sampling data B(t-dt), B(t-2dt), . . . , B(t-ndt) respectively. The multipliers $\mathbf{3}_0, \mathbf{3}_1, \mathbf{3}_2, \ldots, \mathbf{3}_n$ multiplies the sampling data A(t), A(t-dt), A(t-2dt), . . . , A(t-ndt) by B(t), B(t-dt), B(t-2dt), . . . , B(t-ndt) respectively but inversely. Then, the adders $\mathbf{4}_1, \mathbf{4}_2, \ldots, \mathbf{4}_n$ sequentially add the outputs of multipliers $\mathbf{3}_0, \mathbf{3}_1, \mathbf{3}_2, \ldots, \mathbf{3}_n$ together to thereby output an output signal C(t).

As a result, this output signal C(t) can be expressed as follows.

$$C(t)=A(t)*B(t\text{-}ndt)+A(t\text{-}dt)*B(t\text{-}(n-1)dt)+A(t\text{-}2dt)*B(t\text{-}(n-2)dt)+\ldots+A(t\text{-}ndt)*B(t)$$

As described in the above formula, the output signal C(t) means the result of the convolution operation between the inputs A(t) and B(t). For example, the input A(t) can be set as the musical tone waveform signal whose amplitude is continuously varied in lapse of time. In addition, when each of the sampling data B(t-dt), B(t-2dt), . . . , B(t-ndt) is stored in each of the delay circuits $\mathbf{2}_1, \mathbf{2}_2, \ldots, \mathbf{2}_n$, the sequential delay operation (i.e., shift operation) of each sampling data is stopped so that each sampling data is fixed to each delay circuit. Thus, the musical tone waveform signal is applied with the modulation due to the convolution operation based on the input B(t). Therefore, when the impulse response waveform signal indicative of the reverberation characteristic in the room is adopted as the input B(t), it is possible to obtain the musical tone signal to which the reverberation characteristic is applied. On the other hand, when another waveform signal is adopted as the input B(t), it is possible to obtain the musical tone signal to which the brand-new musical effect is applied.

Further, the waveform signal whose amplitude continuously varies in lapse of time can be adopted as the input B(t), while the sequential delay operation of the sampling data B(t-dt), B(t-2dt), . . . , B(t-ndt) at the delay circuits $2_1$, $2_2$, . . . , $2_n$ is continued. In such case, the input A(t) as the musical tone waveform signal is dynamically modulated by the convolution operation based on the input B(t). As a result, it is possible to give the brand-new and complicated modulation effect to the musical tone signal.

[B] CONFIGURATION OF AN EMBODIMENT

Next, description will be given with respect to the concrete configuration of the musical tone signal generating apparatus according to the present embodiment which is applied to the keyboard electronic musical instrument.

Figure 2:
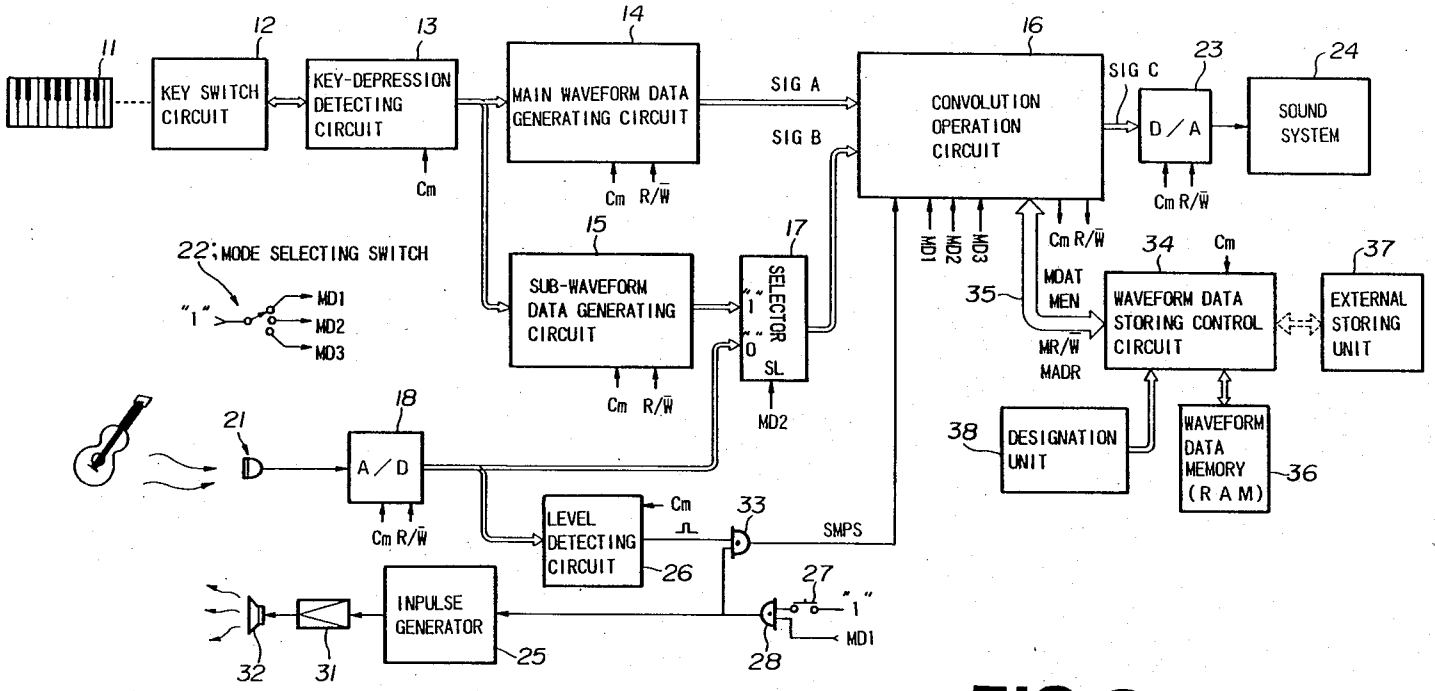
FIG. 2 is a block diagram showing an electronic musical instrument which adopts the musical tone signal generating apparatus according to an embodiment of the present invention.

FIG. 2 is a block diagram showing the whole configuration of the keyboard electronic musical instrument. This electronic musical instrument includes a key switch circuit 12 consisting of plural key switches each corresponding to each of plural keys in a keyboard 11. Each open/close (or on/off) operation of the key switch in the key switch circuit 12 is detected by a key-depression detecting circuit 13. In other words, this circuit 13 detects depression/release operation of each key of the keyboard 11. Thus, the circuit 13 outputs key information indicative of the key which is depressed or released, and then this key information is supplied to a main waveform data generating circuit 14 and a sub-waveform data generating circuit 15.

Based on the key information, the main waveform data generating circuit 14 forms a first continuous musical tone waveform signal having a pitch frequency of the depressed key in the keyboard 11. Then, this circuit 14 outputs sampling data indicative of the instantaneous value of the first continuous musical tone waveform signal to a convolution operation circuit 16 as a waveform signal A. On the other hand, the sub-waveform data generating circuit 15 forms a second continuous musical tone waveform signal having the pitch frequency of the depressed key based on the key information. Then, this circuit 15 output sampling data indicative of the instantaneous value of the second continuous musical tone waveform signal which is different from the waveform signal A, and this sampling data is supplied to a first input ("1") of a selector 17. In order to form the above-mentioned first and second continuous musical tone waveform signals, it is possible to adopt several known methods such as the waveform memory reading method, higher harmonic waveform combining method, operation method and the like.

In addition, an analog-to-digital (A/D) converter 18 is connected to a second input ("0") of the selector 17. The A/D converter 18 converts an analog signal supplied from a microphone 21 into a digital signal, so that the A/D converter 18 outputs this digital signal to the second input of the selector 17 as sampling data indicative of the instantaneous value of the tone which is externally picked up by the microphone 21 (hereinafter, referred to as an external tone). The selector 17 selectively outputs one of two sampling data to the convolution operation circuit 16 as a waveform signal B based on a second mode signal MD2 which is supplied to a selection control terminal SL thereof. When the second mode signal MD2 takes the value "1", the sampling data from the subwaveform data generating circuit 15 is selected. On the other hand, when the second mode signal MD2 takes the value "0", another sampling data from the A/D converter 18 is selected.

This second mode signal MD2 is outputted from a mode selecting switch 22. This mode selecting switch 22 also outputs first and third mode signals MD1 and MD3. Based on the selecting operation of the mode selecting switch 22, any one of the mode signals MD1 to MD3 selectively takes the value "1". In the present embodiment, these mode signals MD1, MD2 and MD3 respectively correspond to the following first, second and third modes which are set in the keyboard electronic musical instrument.

(1) FIRST MODE

The impulse response waveform signal is inputted from the external device. Then, the convolution operation is executed between this impulse response waveform signal and the waveform signal A from the main waveform data generating circuit 14 so that the output musical tone waveform signal is formed. In addition, the convolution operation based on the pre-stored waveform data whose waveform is fixed is executed so that the output musical tone waveform signal is formed, wherein the impulse response waveform data can be applied to this waveform data.

(2) SECOND MODE

The convolution operation is executed between the waveform signal A from the main waveform data generating circuit 14 and another waveform signal B from the sub-waveform data generating circuit 15 so that the output musical tone waveform signal is formed.

(3) THIRD MODE

The convolution operation is executed between the waveform signal A and the external tone signal from the microphone so that the output musical tone waveform signal is formed, wherein the amplitude of waveform signal A may continuously vary in lapse of time but the amplitude of external tone signal may intermittently vary in lapse of time.

Next, under control of these mode signals MD1 to MD3, the convolution operation circuit 16 executes the convolution operation between the waveform signals A and B corresponding to the mode to be set, whereas the detailed description of the convolution operation circuit 16 will be described later. Thus, this circuit 16 generates a series of sampling data each indicating the instantaneous value of the output musical tone waveform. This sampling data is supplied to a digital-to-analog (D/A) converter 23 as an output waveform signal C, wherein the sampling data is converted into the analog signal which is to be supplied to a sound system 24. The sound system 24 comprises an amplifier, speaker and the like so that it generates the musical tone corresponding to the analog signal outputted from the D/A converter 23.

In addition to the above-mentioned elements, the present keyboard electronic musical instrument further includes an impulse generator 25 and a level detecting circuit 26 in order to generate the impulse signal and also input the impulse response waveform signal into the convolution operation circuit 16. Next, an AND circuit 28 inputs the first mode signal MD1 and "1" signal to be supplied thereto via an operation switch 27 which is used for generating the impulse, so that the output thereof is to be supplied to the impulse generator 25. Thus, the impulse generator 25 outputs a pulse signal whose cycle is in synchronism with the leading edge of the output of AND circuit 28. The impulse generator 25 is connected to a speaker 32 via an amplifier 31. Therefore, the pulse signal from the impulse generator 25 is converted into the acoustic signal, so that the speaker 32 generates the sound corresponding to the acoustic signal. Meanwhile, the A/D converter 18 is connected to the level detecting circuit 26. When the level detecting circuit 26 detects that the output signal level of the A/D converter 18 exceeds over the predetermined level by inputting the external tone via the microphone 21, this circuit 26 outputs a pulse signal to a first input of AND circuit 33. In addition, the output of AND circuit 28 is supplied to a second input of the AND circuit 33. Thus, only when the impulse response waveform signal is inputted into the present keyboard electronic musical instrument, the AND circuit 33 supplies a sampling start signal SMPS to the convolution operation circuit 16, wherein this sampling start signal SMPS consists of the pulse signals each of which is in synchronism with the time when the external tone (i.e., impulse response signal) is started to be inputted.

The present keyboard electronic musical instrument further comprises a waveform data storing control circuit 34 in order to restore the waveform data concerning the externally picked-up impulse response waveform signal or use the predetermined waveform data for the convolution operation instead of the waveform signal B in the convolution operation circuit 16, wherein this circuit 34 controls the data transfer with the convolution operation circuit 16. This circuit 34 is connected to the convolution operation circuit 16 via a bus 35 which transmits a memory address signal MADR, a memory read/write control signal MR/$\overline{W}$ and a memory enable signal MEN. Based on these signals, the transfer of memory waveform data MDAT for the convolution operation circuit 16 is controlled. The waveform data storing control circuit 34 is connected with a waveform data memory 36 configured by a random-access memory (RAM). In addition, an external storing unit 37 such as a magnetic disk unit or a magnetic tape unit can be connected to the waveform data storing control circuit 34. Further, the waveform data storing control circuit 34 is connected with a designating unit 38 including plural operation switches. This designating unit 38 controls the read/write operation of waveform data for the waveform data memory 36 and external storing unit 37.

Incidentally, a master clock signal Cm and a read/write control signal R/$\overline{W}$ from the convolution operation circuit are supplied to several circuits within the present keyboard electronic musical instrument according to needs. In response to these signals Cm and R/$\overline{W}$, the synchronizing operation of each circuit is controlled.

Next, description will be given with respect to the detailed configuration of the convolution operation circuit 16 by referring to FIG. 3.

Figure 3:
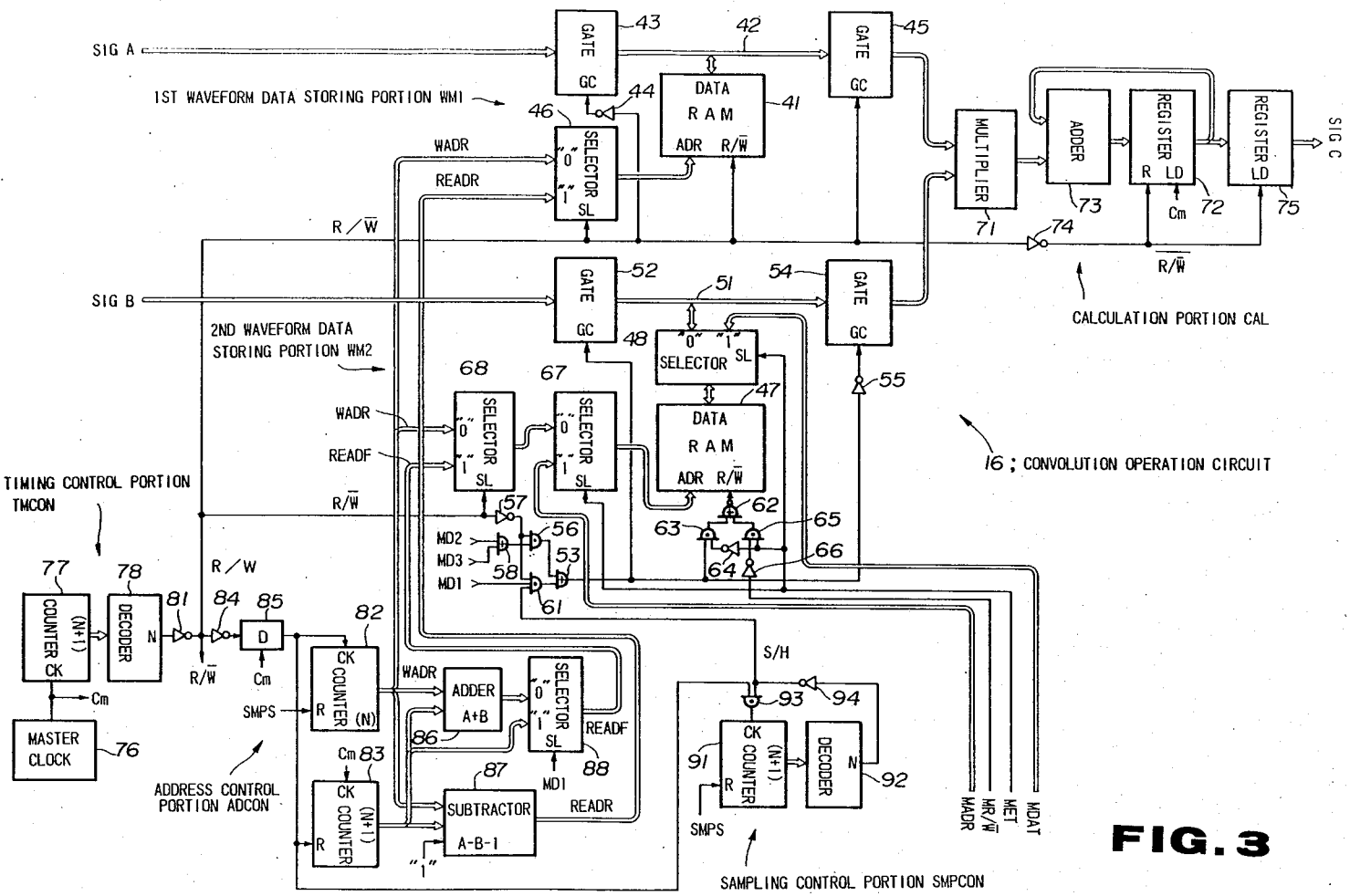
FIG. 3 is a block diagram showing a detailed electric configuration of a convolution operation circuit shown in FIG. 2.

The convolution operation circuit 16 as shown in FIG. 3 comprises: a first waveform data storing portion WM1 for storing each of first sampling data which form the waveform signal A; a second waveform data storing portion WM2 for storing each of second sampling data which form the waveform signal B; a calculation portion CAL for executing the convolution operation; a timing control portion TMCON for controlling the operation timings at the whole parts of the keyboard electronic musical instrument; an address control portion ADCON for controlling the read/write operations of each sampling data in the first and second waveform data storing portions WM1 and WM2; and a sampling control portion SMPCON for controlling the input of impulse response waveform signal.

The first waveform data storing portion WM1 includes a memory 41 consisting of the RAM having N storing areas. A data input/output terminal DATA of this memory 41 is connected to a bus 42, while a read/write control signal R/$\overline{W}$ (see FIG. 4) from the timing control portion TMCON is supplied to a read/write control terminal R/$\overline{W}$ thereof. When the signal R/$\overline{W}$ takes the value "1", the reading operation of sampling data from the memory 41 is controlled. When the signal R/$\overline{W}$ takes the value "0", the writing operation of sampling data into the memory 41 is controlled. The input side of bus 42 is connected to a gate circuit 43 whose gate control terminal GC is connected to an inverter 44. Therefore, an inverted read/write control signal $\overline{R/W}$ is supplied to the gate control terminal GC of the gate circuit 43. When this inverted read/write control signal $\overline{R/W}$ takes the value "1", the gate circuit 43 is turned on so that the first sampling data for the waveform signal A is transmitted to the bus 42. On the other hand, the output side of bus 42 is connected with another gate circuit 45. When the read/write control signal R/$\overline{W}$ to be supplied to a gate control terminal GC of the gate circuit 45 takes the value "1", the gate circuit 45 is turned on so that the sampling data on the bus 42 is transmitted to the calculation portion CAL. In addition, an output terminal of a selector 46 is connected to an address input ADR of the memory 41, wherein this selector 46 is controlled by the read/write control signal R/$\overline{W}$ supplied to a selection control terminal SL thereof. When the signal R/$\overline{W}$ takes the value "0", the selector 46 selects a write address signal WADR from the address control portion ADCON. When this signal R/$\overline{W}$ takes the value "1", the selector 46 selects a review (or rewinding) read address signal READR from the address control portion ADCON.

Similarly, the second waveform data storing portion WM2 includes a memory 47 consisting of the RAM having N storing areas. A data input/output terminal DATA of this memory 47 is connected to a selector 48 whose selection control terminal SL is supplied with a memory enable signal MEM outputted from the waveform data storing control circuit 34 (see FIG. 2). When this signal MEM takes the value "0", it is permitted that the sampling data is transferred between the memory 47 and a bus 51. When this signal MEM takes the value "1", it is permitted that the sampling data (i.e., memory waveform data MDATA) is transferred between the memory 47 and the waveform data storing control circuit 34. The input side of bus 51 is connected to a gate circuit 52 whose gate control terminal GC is supplied with an output of OR circuit 53. When the output of OR circuit 53 takes the value "1", the gate circuit 52 is turned on so that the second sampling data for the waveform signal B is transmitted onto the bus 51. The output side of bus 51 is connected to another gate circuit 54 whose gate control terminal GC is supplied with an output of an inverter 55 to which the output of OR circuit 53 is supplied. When the output of inverter 55 takes the value "1", the gate circuit 54 is turned on so that the sampling data on the bus 51 is transmitted to the calculation portion CAL.

The first input of OR circuit 53 is supplied with an output of AND circuit 56. The inverted read/write control signal $\overline{R/W}$ from an inverter 57 is supplied to the first input of AND circuit 56, while an output of OR circuit 58 is supplied to the second input of AND circuit 56, wherein the second and third mode signals MD2 and MD3 are supplied to the OR circuit 58. Therefore, when the second or third mode is set in the present keyboard electronic musical instrument, the OR circuit 53 outputs the inverted read/write control signal $\overline{R/W}$. On the other hand, an output of AND circuit 61 is supplied to a second input of the OR circuit 53. This AND circuit 61 is supplied with the inverted read/write control signal $\overline{R/W}$, the first mode signal MD1 and a sample/hold signal S/H from the sampling control portion SMPCON. In the first mode, the OR circuit 53 outputs the inverted read/write control signal $\overline{R/W}$ under the condition where the sample/hold signal S/H takes the value "1".

Meanwhile, an output of a NOR circuit 62 is supplied to a read/write control terminal $R/\overline{W}$ of the memory 47. The reading operation of this memory 47 is controlled when the output of NOR circuit 62 takes the value "1", while the writing operation thereof is controlled when it takes the value "0". A first input of this NOR circuit 62 is supplied with an output of AND circuit 63. The output of OR circuit 53 is supplied to a first input of the AND circuit 63, while an output of inverter 64 is supplied to a second input of the AND circuit 63. The memory enable signal MEN is supplied to the inverter 64 so that an inverted memory enable signal $\overline{MEN}$ is supplied to the second input of AND circuit 63. Due to the operations of the NOR circuit 62 and AND circuit 63, when the memory enable signal MEN takes the value "0", the inverted output of OR circuit 53 is supplied to the read/write control terminal $R/\overline{W}$ of the memory 47. On the other hand, an output of AND circuit 65 is supplied to a second input of the NOR circuit 62. An output of inverter 66 is supplied to a first input of the AND circuit 65, while the foregoing memory enable signal MEN is supplied to a second input of the AND circuit 65. The memory read/write control signal $MR/\overline{W}$ from the waveform data storing control circuit 34 (shown in FIG. 2) is supplied to the inverter 66 so that the inverted memory read/write control signal $\overline{MR/W}$ is supplied to the second input of AND circuit 65. Due to the operations of the NOR circuit 62 and AND circuit 65, when the memory enable signal MEN takes the value "1", the inverted read/write control signal $\overline{MR/W}$ is further inverted and then supplied to the read/write control terminal $R/\overline{W}$ of the memory 47.

Next, an output of selector 67 is supplied to an address input terminal ADR of the memory 47. This selector 67 is controlled by the memory enable signal MEN supplied to a selection control terminal SL thereof, wherein this memory enable signal MEN is outputted from the waveform data storing control circuit 34 (shown in FIG. 2). The selector 67 selects an output of selector 68 when the memory enable signal MEN takes the value "0", while the selector 67 selects the memory address signal MADR from the waveform data storing control circuit 34 when it takes the value "1". The selector 68 is controlled by the read/write control signal $R/\overline{W}$ supplied to a selection control terminal SL thereof. This selector 68 selects the write address signal WADR from the address control portion ADCON when the signal $R/\overline{W}$ takes the value "0", while the selector 68 selects a forward read address signal READF from the address control portion ADCON when the signal $R/\overline{W}$ takes the value "1".

The calculation portion CAL includes a multiplier 71 which is connected with the gate circuits 45 and 54. This multiplier 71 multiplies the outputs of gate circuits 45 and 54 together, so that the multiplication result is supplied to a first input of adder 73. The adder 73 and a register 72 configures an accumulator. Then, an output of this register 72 is supplied to a second input of the adder 73. Therefore, the adder 73 adds the multiplication result from the multiplier 71 and the output of register 72 together, so that the addition result of adder 73 is supplied to the input of register 72. The register 72 is reset by an output of inverter 74 (i.e., inverted read/write control signal $\overline{R/W}$) supplied to a reset terminal R thereof, while the register 72 renews and then stores the output of adder 73 in synchronism with the master clock signal Cm supplied to a load terminal LD thereof. Thereafter, a register 75 renews and then stores the output of register 72 every time the inverted read/write control signal $\overline{R/W}$ is supplied to a load terminal LD thereof.

Figure 4:
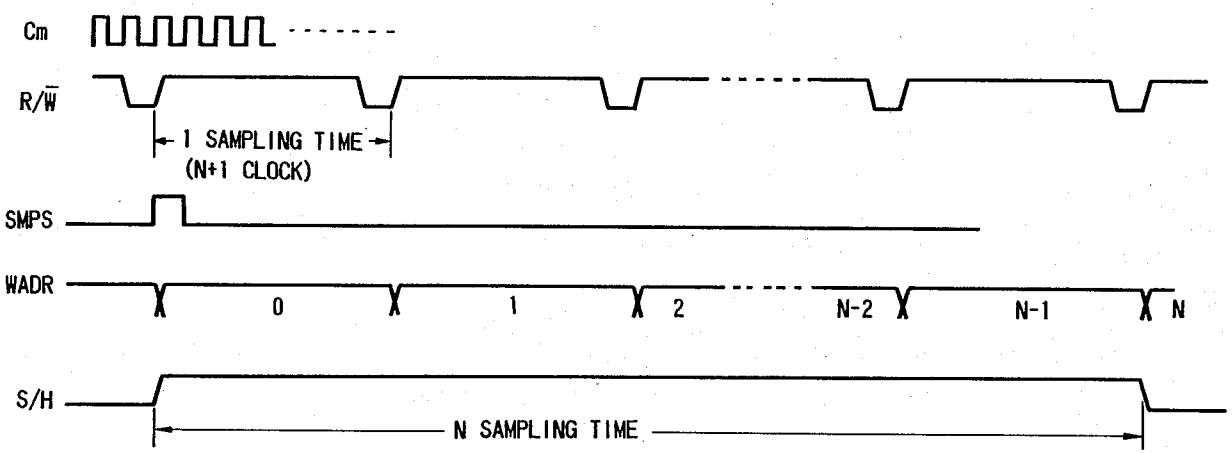
FIGS. 4, 6, 8 and 9 show time charts which are used for explaining operations of the electronic musical instrument shown in FIG. 2.

Next, the timing control portion TMCON includes a master clock generator 76 which generates the master clock signal Cm (see FIG. 4) having high frequency. This master clock signal Cm is supplied to a counter 77 and other circuits, whereby the basic operation timings of several circuits are controlled by the master clock signal Cm. This counter 77 is designed as the modulo N+1 counter, so that it repeatedly counts up the values between "0" and "N". A decoder 78 is connected to the counter. When the decoder 78 detects that the counter 77 counts the value "N", the decoder 78 outputs the "1" signal. Such output of decoder 78 is inverted by an inverter 81, so that the inverted output of decoder 78 is used as the foregoing read/write control signal $R/\overline{W}$. As shown in FIG. 4, the value of this read/write control signal $R/\overline{W}$ turns to "0" every time the counter 77 counts N+1 master clocks in the master clock signal Cm. In the present embodiment, such N+1 clock period corresponds to one sampling time.

The address control portion ADCON provides a modulo N counter 82 and a modulo N+1 counter 83. The above-mentioned read/write control signal $R/\overline{W}$ is inverted by an inverter, and then the inverted read/write control signal $\overline{R/W}$ is delayed by one master clock period in a delay circuit 85. Such output of delay circuit 85 is supplied to a clock input terminal CK of the counter 82, whereby the counter 82 repeatedly counts up so that the counter 82 outputs the write address signal WADR (see FIG. 4) whose value varies from "0" to "N−1" by every sampling time. In addition, this counter 82 is reset by the foregoing sampling start signal SMPS supplied to a reset terminal R thereof. On the other hand, the output of delay circuit 85 is supplied to a reset terminal R of the counter 83, while the master clock signal Cm is supplied to a clock input terminal CK thereof. The count value of counter 83 is reset to "0" in synchronism with the counting operation of the counter 82. This counter 83 outputs the count value which varies from "0" to "N" within one sampling time.

The outputs of these counters 82 and 83 are both supplied to an adder 86 and a subtractor 87. The adder 86 adds the write address signal WADR from the counter 82 and the output of counter 83 together to thereby obtain the addition result, which is then outputted to a first input of selector 88. In addition, the output of counter 83 is supplied to a second input of the selector 88. This selector 88 is controlled by the first mode signal MD1 supplied to a selection control terminal SL thereof. The selector 88 selectively outputs the addition result from the adder 86 as the forward read address signal READF when the first mode signal MD1 takes the value "0", while the selector 88 selectively outputs the output of counter 88 as the signal READF when it takes the value "1". The subtractor 87 subtracts the count value of counter 83 and value "1" from the value of write address signal WADR from the counter 82 to thereby obtain the subtraction result, which is then outputted as the review read address signal READR.

The sampling control portion SMPCON provides a modulo N+1 counter 91 and a decoder 92. The sampling start signal SMPS is supplied to a reset terminal R of the counter 91, while an output of AND circuit 93 is supplied to a clock input terminal CK of the counter 91. This AND circuit 93 inputs the sample/hold signal S/H and the output of delay circuit 85. Therefore, the count value of counter 91 is reset to "0" when the sampling start signal SMPS is supplied thereto. In addition, during the value of sample/hold signal S/H is at "1", the counter 91 counts up by every sampling time. When the decoder 92 detects that the count value of counter 91 becomes equal to "N", the decoder 92 output the "1" signal. Such output of decoder 92 is inverted by an inverter 94, so that the inverted output of decoder 92 is used as the sample/hold signal S/H.

[C] OPERATION OF AN EMBODIMENT

Next, description will be given with respect to the operation of the above-mentioned embodiment by each of first to third modes.

(1) FIRST MODE

In this first mode, the convolution operation of the waveform signal A is executed by mainly using the impulse response waveform signal. In order to set the first mode, the value of first mode signal MD1 is only set to "1" but other values of second and third mode signals MD2 and MD3 are set to "0".

First, description will be given with respect to the case where the waveform data concerning the impulse response signal is inputted into the present keyboard electronic musical instrument. In this case, the player turns on the operation switch 27. Thus, based on the first mode signal MD1 whose value is set to "1", the AND circuit 28 outputs the "1" signal to the impulse generator 25, from which the pulse signal is outputted via the amplifier 31. As described before, this pulse signal is converted into the acoustic signal, so that the sound according to the acoustic signal is generated from the speaker 32 in the room where the present keyboard electronic musical instrument is placed. The sound corresponding to the acoustic signal (i.e., impulse signal) is partially reflected and partially absorbed by the walls and some objects placed in the room, and thereafter such sound is partially picked up by the microphone 21. Then, the microphone 21 generates the analog waveform signal indicative of the impulse response of the room, and this analog waveform signal is supplied to the A/D converter 18. Under control of the master clock signal Cm and read/write control signal $R/\overline{W}$, the A/D converter 18 converts the instantaneous value of the analog waveform signal into the digital signal by every sampling time (see FIG. 4). This digital signal is outputted to the selector 17 as the sampling data concerning the impulse response waveform signal by every sampling period. In the present first mode, the second mode signal MD2 takes the value "0". Therefore, the selector 17 outputs the sampling data from the A/D converter 18 to the convolution operation circuit 16 as the waveform signal B.

The above digital signal from the A/D converter 18 is also supplied to the level detecting circuit 26. When this circuit 26 detects the digital signal whose level is larger than the predetermined level, it outputs the pulse signal at the head timing of one sampling time, wherein this pulse signal indicates the start timing of inputting the impulse response waveform signal. In fact, this pulse signal is generated at the almost same time when the impulse signal is outputted. At this time, the operation switch 27 is still on so that the AND circuit 28 outputs the "1" signal. Therefore, the pulse signal from the level detecting circuit 26 is supplied to the convolution operation circuit 16 as the sampling start signal SMPS (see FIG. 4) via the AND circuit 33.

In the convolution operation circuit 16 shown in FIG. 3, the sampling start signal SMPS resets the counter 91 within the sampling control portion SMPCON so that the decoder 92 outputs the "0" signal which turns the sample/hold signal S/H to the "1" signal. This sample/hold signal S/H having value "1" is supplied to the AND circuit 61. Since the first mode signal MD1 supplied to the AND circuit 61 takes the value "1", the inverted read/write control signal $\overline{R/W}$ is supplied to the gate circuit 52 via the AND circuit 61 and OR circuit 53. Thus, the gate circuit 52 will be turned on at every last timing of each sampling time. Meanwhile, since the memory enable signal MEN from the waveform data storing control circuit 34 takes the value "0", the selector 48 permits the data transfer between the bus 51 and the data input/output terminal DATA of memory 47. Thus, the waveform signal B (i.e., the sampling data indicative of the impulse response waveform signal) is supplied to the data input/output terminal DATA of memory 47 via the gate circuit 52, bus 51 and selector 48 at every last timing of each sampling time. In addition, since the memory enable signal MEN takes the value "0", the AND circuit 63 supplies the inverted read/write control signal $\overline{R/W}$ from the OR circuit 53 to the NOR circuit 62. This NOR circuit 62 further inverts the inverted signal $R/\overline{W}$ to thereby output the read/write control signal $\overline{R/W}$ to the read/write control terminal $R/\overline{W}$ of the memory 47. This turns the mode of memory 47 into the write mode at every last timing of each sampling time so that the sampling data will be written into the memory 47.

Figure 5:
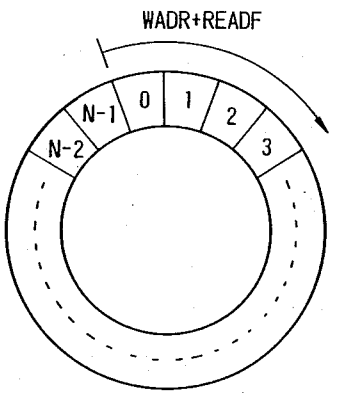

Meanwhile, the above-mentioned sampling start signal SMPS resets the counter 82. Therefore, after this signal SMPS is generated, the counter 82 outputs the write address signal WADR whose value increments from "0" by every sampling period as shown in FIG. 4. Such write address signal WADR is supplied to the "0" terminal of selector 68 so that the selector 68 supplies this signal WADR to the "0" terminal of selector 67 based on the read/write control signal $R/\overline{W}$ at every last timing of each sampling time. In this case, the memory enable signal MEN takes the value "0" as described before, so that the selector 67 supplies the output signal of selector 68 to the address input ADR of memory 47. Therefore, at every last timing of each sampling time, the foregoing write address signal WADR is supplied to the address input ADR of memory 47. As a result, as shown in FIG. 5, the sampling data indicative of the impulse response waveform is sequentially stored in each address of memory 47 from its address 0 by every sampling time.

When the count value of counter 91 within the sampling control portion SMPCON reaches at "N" while above sampling data is written into the memory 47, the decoder 92 outputs the "1" signal which turns the sample/hold signal S/H to "0" signal. Such sample/hold signal S/H stops the counting operation of counter 91, so that the value thereof remains at "0". In addition, this sample/hold signal S/H having value "0" makes the AND circuit 61 to output the "0" signal. At this time, the operation of writing the sampling data into the memory 47 is stopped. Incidentally, the counter 82 operates in synchronism with the counter 91. Therefore, at this timing, the value of write address signal WADR reaches at "N−1", so that the sampling data are written into all areas (i.e., addresses 0 to N−1) of the memory 47.

Next, description will be given with respect to the operation of forming the musical tone signal by using the waveform data of impulse response signal to be written into the memory 47.

First, when any one of keys in the keyboard 11 is depressed, this key-depression is detected by the key switch circuit 12 and key-depression detecting circuit 13, so that the key information concerning the key-depression is supplied to the main waveform data generating circuit 14. Based on such key information, the main waveform data generating circuit 14 forms the musical tone waveform signal having the pitch frequency of depressed key. Then, the sampling data indicative of the instantaneous value of this musical tone waveform signal is supplied to the convolution operation circuit 16 as the waveform signal A (see FIG. 6) in synchronism with the read/write control signal R/$\overline{W}$.

Figure 7:
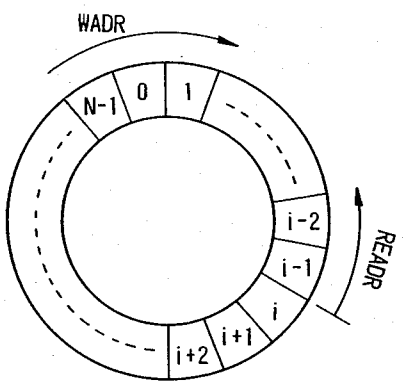
FIGS. 5, 7, 10 and 11 show memory maps which are used for explaining reading/writing operations of a memory shown in FIG. 2.

In the convolution operation circuit 16, the gate circuit 43 within the first waveform data storing portion WM1 is turned on by the inverted read/write control signal $\overline{R/W}$ which has been inverted by the inverter 44. Therefore, the gate circuit 43 supplies each of first sampling data for the waveform signal A to the data input/output terminal DATA of memory 41 by every last timing of each sampling time. At this last timing of each sampling time, the read/write control signal R/$\overline{W}$ controls the selector 46 such that the write address signal WADR from the counter 82 is supplied to the address input ADR of memory 41. In addition, this signal R/$\overline{W}$ also controls the memory 41 such that the mode of memory 41 is turned into the write mode. In this case, the value of write address signal WADR increments from "0" to "N−1" in one sampling time. Therefore, as shown in FIG. 7, the address of memory 41 in which the first sampling data for the waveform signal A is written is incremented from "0". But, when the address of memory 41 reaches at N−1 address, the address number turns to "0". In such manner, the sampling data are sequentially stored in the memory 41. Thus, every time the new sampling data is supplied to the data input/output terminal DATA of memory 41, the oldest sampling data stored in the memory 41 is rewritten by the new sampling data. In other words, the memory 41 circulatingly stores the first sampling data indicative of the waveform signal A.

Figure 6:
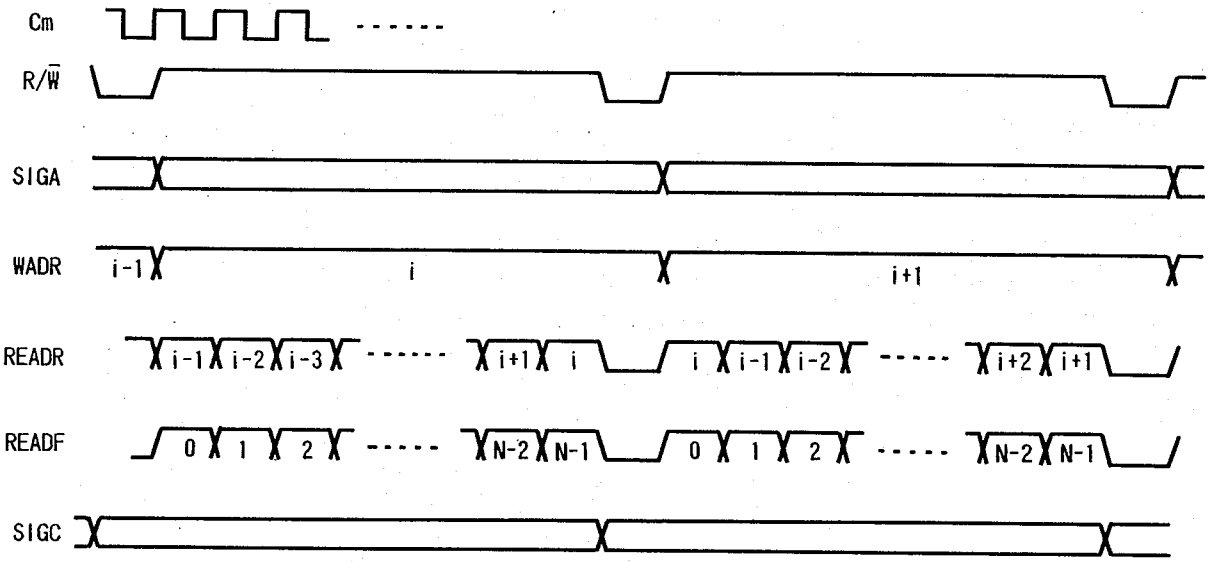

Meanwhile, during the above-mentioned circulatingly storing operation, the sampling data are sequentially read from the memory 41 at the timings other than the last timing of each sampling time. More specifically, as shown in FIG. 6, the read/write control signal R/$\overline{W}$ takes the value "1" at the clock timings indicative of the count values "0" to "N−1" within one sampling time. This signal R/$\overline{W}$ is supplied to the terminal R/$\overline{W}$ of the memory 41 so that the read mode is set to the memory 41. In addition, this signal R/$\overline{W}$ is also supplied to the gate control terminal GC of gate circuit 45 so that the gate circuit 45 is turned on. Further, this signal R/$\overline{W}$ is supplied to the selection control terminal SL of selector 46, whereby this signal R/$\overline{W}$ controls the selector 46 such that the review read address signal READR is supplied to the address input ADR of memory 41 at the clock timings "0" to "N−1". Thus, the sampling data stored in the memory 41 are sequentially read out in response to the review read address signal READR at the clock timings "0" to "N−1" in one sampling time.

The above review read address signal READR is formed in the subtractor 87. After the counter 83 is reset at the head timing of one sampling time, the value of write address signal WADR from the counter 82 is incremented by every master clock. Hence, in the case where this write address signal WADR takes the value "i", its value changes in the order of "i−1", "i−2", . . . , "i" by every clock timing as shown in FIGS. 6 and 7. In such state, the sampling data has not been written into address i of the memory 41, hence, the newest sampling data is stored in address i−1 of the memory 41. Therefore, as the address number becomes smaller, the older sampling data is written in. For this reason, the oldest sampling data is written into address i of the memory 41. As a result, as the reading operation proceeds, the sampling data to be read becomes older by every clock timing. Such read sampling data are sequentially written into the first input of multiplier 71.

At the same time, another sampling data from the second waveform data storing portion WM2 is supplied to the second input of multiplier 71. In this case, the first mode signal MD1 takes the value "1", but other second and third mode signals both take the value "0", and the sample/hold signal S/H from the sampling control portion SMPCON takes the value "0". Hence, under operations of the AND circuits 56 and 61, the output of OR circuit 53 must be remained at "0". Thus, the "1" signal from the inverter 55 is supplied to the gate control terminal GC of gate circuit 54 so that the gate circuit 54 turns on. At this time, the memory enable signal MEN from the waveform data storing control circuit 34 takes the value "0". Therefore, the selector 48 permits the data transfer between the bus 51 and data input/output terminal DATA of memory 47. Under operations of the AND circuits 63, 65 and NOR circuit 62, the read mode is set to the memory 47. As a result, the sampling data is read from the memory 47, and this read sampling data is supplied to the second input of multiplier 71 via the selector 48, bus 51 and gate circuit 54.

Meanwhile, based on the read/write control signal R/$\overline{W}$ (see FIG. 6), the selector 68 supplies the forward read address signal READF from the selector 88 to the "0" input of selector 67 at the clock timings "0" to "N−1" in one sampling time. At the same time, based on the first mode signal MD1 whose value is set to "1", the selector 88 selectively outputs the output of counter 83. Based on the memory enable signal MEN whose value is set to "0", the selector 67 selectively outputs the output of selector 68. Thus, at the clock timings "0" to "N−1", the forward read address signal READF whose value sequentially changes from "0" to "N−1" as shown in FIG. 6 is supplied to the address input ADR of memory 47. As a result, in synchronism with the operation of reading the sampling data in the first waveform data storing portion WM1, the sampling data indicative of the impulse response waveform pre-stored in the memory 47 as shown in FIG. 5 are sequentially read out and then supplied to the second input of multiplier 71.

Both of the sampling data outputted from the first and second waveform data storing portions WM1 and WM2 are multiplied together in the multiplier 71. Then, the multiplication result of multiplier 71 is added with the sampling data from the register 72 in the adder 73. Thereafter, the addition result of adder 73 is stored in the register 72 in synchronism with the master clock signal Cm. This register 72 is reset by the inverted read/write control signal $\overline{R/W}$ outputted from the inverter 74 at every last timing of one sampling time. Thus, the adder 73 and register 72 accumulates the multiplication result of the multiplier 71 during one sampling time. Then, the register 75 which is controlled by the inverted read/write control signal $\overline{R/W}$ inputs the accumulation result just before the register 72 is reset. This register 75 outputs the above accumulation result as an output signal C shown in FIG. 6. This signal C indicates the sampling data which obtained by executing the convolution operation on two sampling data during one sampling time.

Thereafter, such sampling data indicative of the output signal C is supplied to the D/A converter 23 (shown in FIG. 2), wherein the sampling data is converted into the analog signal. Hence, the sound system 24 generates the musical tone corresponding to the analog signal. Thus, the musical tone to be generated by the sound system 24 is the result of the convolution operation between the musical tone waveform signal from the main waveform data generating circuit 14 and the impulse response characteristic of the room where the present keyboard electronic musical instrument is placed. Therefore, the generated musical tone simulates the reverberation characteristic of the room.

Figure 8:
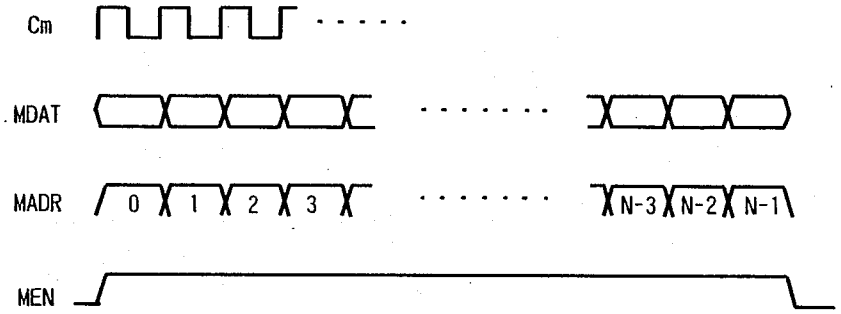

The present keyboard electronic musical instrument can preserve the waveform data of impulse response signal. Or, it is possible to use other pre-stored waveform data of impulse response signal of the room or places for the convolution operation. In this case, the player operates several operation switches in the designating unit 38 to thereby designate the transfer of waveform data from the memory 47 to the waveform data memory 36 or external storing unit 37. Or, the designating unit 38 designates the transfer of waveform data from the waveform data memory 36 or external storing unit 37 to the memory 47. Under such designation, the waveform data storing control circuit 34 outputs the memory address signal MADR whose value changes from "0" to "N−1" in synchronism with the master clock signal Cm. In addition, this circuit 34 also outputs the memory enable signal MEN whose value is at "1" during N clocks (see FIG. 8). This memory enable signal MEN is supplied to the selection control terminals SL of the selectors 67 and 68 respectively. The selector 67 supplies the memory address signal MADR to the address input ADR of memory 47, while the selector 48 permits the data transfer between the waveform data storing control circuit 34 and data input/output terminal DATA of memory 47.

In the case where the designating unit 38 designates the data transfer from the memory 47 to the waveform data memory 36 or external storing unit 37, the waveform data storing control circuit 34 outputs the memory read/write control signal MR/$\overline{W}$ having value "1" in addition to the signals MADR and MEN. At this time, the memory enable signal MEN takes the value "1", so that the AND circuit 65 outputs the inverted memory read/write control signal $\overline{MR/W}$ which is outputted from the inverter 66. This inverted signal $\overline{MR/W}$ is further inverted by the NOR circuit 62 so that the signal MR/$\overline{W}$ is supplied to the read/write control terminal R/$\overline{W}$ of memory 47. Hence, the read mode is set to the memory 47. Thus, the sampling data are sequentially read from the memory 47 in response to the memory address signal MADR whose value changes from "0" to "N−1". Then, this sampling data is supplied to the waveform data storing control circuit 34 via the selector 48. Thereafter, the sampling data from the waveform data storing control circuit 34 is stored at the designated position in the waveform data memory 36 or external storing unit 37. Hence, it is possible to preserve the waveform data concerning the impulse response signal to be picked up as described before. The present invention is not limited to use this impulse response waveform signal of the room. Instead, it is possible to use other waveform having the length which is similar to that of the impulse response waveform signal. In short, it is possible to preserve the waveform data concerning several external tones by the operations described above.

On the other hand, in the case where the designating unit 38 designates the data transfer from the waveform data memory 36 or external storing unit 37 to the memory 47, the waveform data storing control circuit 34 outputs the waveform data consisting of N sampling data and memory read/write control signal MR/$\overline{W}$ having value "0" in addition to the signals MADR and MEN, wherein N sampling data are read from the waveform data memory 36 or external storing unit 37. As described before, the memory enable signal MEN sets the write mode to the memory 47 based on the memory read/write control signal MR/$\overline{W}$. Hence, the sampling data from the waveform data memory 36 or external storing unit 37 are sequentially stored in addresses 0 to N−1 of the memory 47. When the key-depression event is occurred in the keyboard 11 in such state, the convolution operation circuit 16 executes the convolution operation between the musical tone waveform data from the main waveform data generating circuit 14 and another waveform data from the waveform data memory 36 or external storing unit 37. In this case, it is possible to store the waveform data of impulse response signal, waveform data concerning the acoustic characteristics of several kinds of amplifiers and plates (of piano, guitar etc.) or other waveform data concerning the musical instrument tone, animal cry or natural sound in the waveform data memory 36 or external storing unit 37. Thus, it is possible to obtain the musical tone to which several kinds of musical effects are applied or another musical tone to which the specific modulation is applied.

(2) SECOND MODE

In this second mode, the convolution operation is executed between the waveform signal A from the main waveform data generating circuit 14 and the waveform signal B from the sub-waveform data generating circuit 15, wherein both of these waveform signals A and B varied in lapse of time. In response to the key-depression of keyboard 11, the main waveform data generating circuit 14 outputs the musical tone waveform data as the waveform signal A. Then, the first waveform data storing portion WM1 within the convolution operation circuit 16 circulatingly stores each of the sampling data of the waveform signal A by every sampling time. At the same time, the sampling data are sequentially outputted to the calculation portion CAL by every clock timing in each sampling time in such a manner that the newer sampling data is outputted after the older sampling data is outputted. This operation in the second mode is identical to that of the first mode.

Meanwhile, in this second mode, only the second mode signal takes the value "1", so that the sampling data from the sub-waveform data generating circuit 15 is outputted to the convolution operation circuit 16 as the waveform signal B under operation of the selector 17. This sampling data is formed in the sub-waveform data generating circuit 15 and it indicates the musical tone waveform having the pitch frequency of the depressed key in the keyboard 11. In addition to the waveform signal A, such sampling data is continuously supplied to the second waveform data storing portion WM2 in the convolution operation circuit 16.

Figure 11:
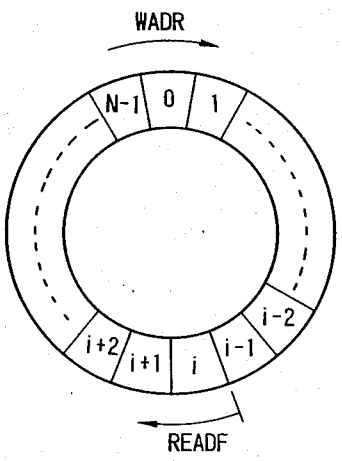
Figure 9:
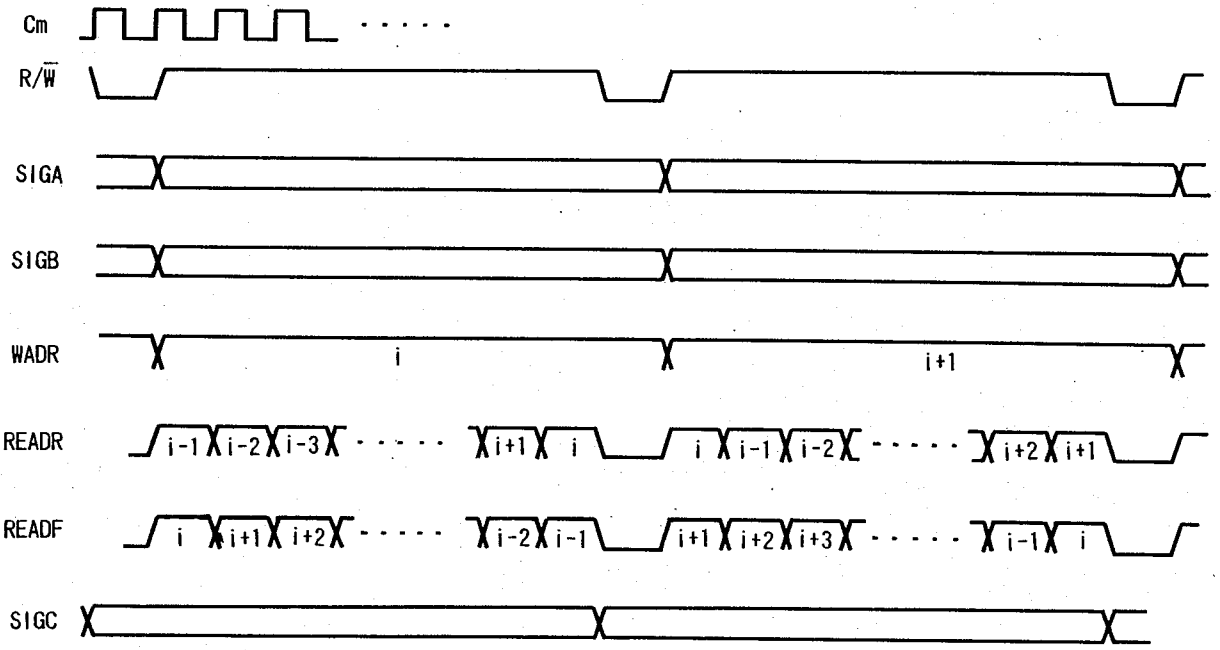

In this second waveform data storing portion WM2, the second mode signal MD2 having the value "1" is supplied to the AND circuit 56 via the OR circuit 58, while the inverted memory enable signal $\overline{MEN}$ from the inverter 64 is supplied to the AND circuit 63, wherein the inverted signal $\overline{MEN}$ takes the value "1". Hence, as similar to the first waveform data storing portion WM1, the read/write control signal $R/\overline{W}$ is supplied to the selector 68, and the inverted read/write control signal $R/\overline{W}$ is supplied to the gate control terminal GC of gate circuit 52. In addition, this inverted signal $R/\overline{W}$ is further inverted by the NOR circuit 62 and inverter 55, so that the read/write control signal $R/\overline{W}$ is supplied to the terminal $R/\overline{W}$ of memory 47 and the gate control terminal GC of gate circuit 54. Due to the memory enable signal MEN having the value "0", the selector 48 permits the data transfer between the bus 51 and the data input/output terminal DATA of memory 47. Thus, even in the second waveform data storing portion WM2, the oldest sampling data indicative of the waveform signal B is rewritten by the newest sampling data by every last timing of one sampling time as shown in FIGS. 9 and 11. Such sampling data are sequentially and circulatingly stored in addresses 0, 1, . . . , N−1, 0, 1, . . . of the memory 47.

Meanwhile, in the read mode of memory 47 at the clock timings "0" to "N−1" in one sampling time, the selector 68 supplies the forward read address signal READF from the selector 88 to the address input ADR of memory 47 via the selector 67. In this case, the first mode signal MD1 having the value "0" is supplied to the selection control terminal SL of selector 88, from which the output signal of adder 86 is outputted as the forward read address signal READF. The adder 86 adds the write address signal WADR and the count value of counter 83 together, wherein the count value is incremented from "0" to "N" by every clock timing in one sampling time. In the case where write address signal WADR indicates the value "i", the value of forward read address signal READF varies as "i", "i+1", . . . , "i−2", "i−1" shown in FIGS. 9 and 11. In these clock timings "0" to "N−1", new sampling data has not been written into the memory 47 yet. Hence, the sampling data read from the memory 47 are sequentially outputted from the oldest to the newer, and the read sampling data is supplied to the calculation portion CAL.

Figure 10:
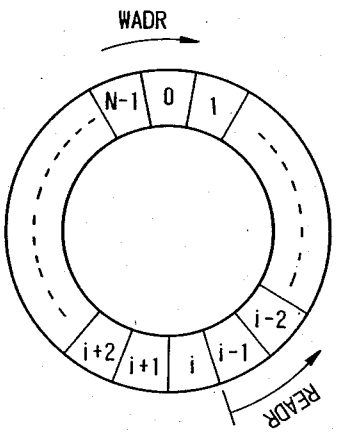

As similar to the case of first mode, the calculation portion CAL executes the convolution operation on the two sampling data respectively outputted from the first and second waveform data storing portions WM1 and WM2, so that the output sampling data indicative of the output waveform signal C are sequentially outputted by every sampling time. In this case, as shown in FIGS. 10 and 11, the sampling data from the first waveform data storing portion WM1 sequentially changes from the new to the older in one sampling time. In contrast, the sampling data from the second waveform data storing portion WM2 sequentially changes from the old to the newer. Therefore, the present instantaneous value and previous instantaneous value in each musical tone waveform signal are modulated together, so that the complicated and variable musical tone waveform signal is to be formed. Then, the sound system 24 outputs the musical tone corresponding to such musical tone waveform signal. Thus, in the second mode, it is possible to obtain the musical tone having much variety which can not be obtained in the conventional apparatus.

(3) THIRD MODE

In this third mode, the convolution operation is executed between the waveform signal A from the main waveform data generating circuit 14 and the external tone from the microphone 21, wherein the waveform signal A varies in lapse of time and the external tone waveform varies intermittently in lapse of time. In this case, under operation of the mode selecting switch 22, the value "1" is set to the third mode signal MD3 only but the value "0" is set to other first and second mode signals MD1 and MD2.

The external tone picked up from the microphone 21 is converted into the digital signal consisting of plural sampling data in the A/D converter 18. The selector 17 supplies this sampling data to the convolution operation circuit 16 as the waveform signal B in synchronism with the sampling time. In the convolution operation circuit 16, the second and third mode signals MD2 and MD3 are supplied to the OR circuit 58 in parallel. Hence, as similar to the case of second mode, the convolution operation circuit 16 operates in this third mode. In this case, the microphone 21 continuously inputs the external tone which is obtained by performing the musical instrument or which is obtained from the tone source other than the musical instrument. Thus, the plural instantaneous values of the musical tone waveform signal from the main waveform data generating circuit 14 which changes from the present to the previous are respectively modulated with other plural instantaneous values of the external tone waveform signal which changes from the previous to the present, whereby the sound system 24 will generate the brand-new variable musical tone which is complicatedly modulated by the external tone.

[D] MODIFIED EXAMPLES OF AN EMBODIMENT

In the foregoing first mode where the convolution operation is executed by using the waveform data which is provided in advance, the waveform data from the waveform data memory 36 or external storing unit 37 is temporarily transferred to the memory 47, and thereafter the operation of reading such waveform data is controlled and then the waveform data is supplied to the calculation portion CAL. However, instead of such manner, it is possible to repeatedly read out the waveform data and then directly supply the waveform data to the calculation portion CAL. Or, it is possible to provide a read-only memory (ROM) for storing several waveform data in advance. In this case, the waveform data pre-stored in the ROM is selectively and repeatedly outputted to the calculation portion CAL in the first mode.

In the present embodiment, the musical tone waveform signals are not directly outputted from the main waveform data generating circuit 14 and sub-waveform data generating circuit 15. Instead, it is possible to provide the adder in front of the D/A converter 23, wherein this adder adds each musical tone waveform signal and the waveform signal C from the convolution operation circuit 16 together.

This invention may be practiced or embodied in still other ways without departing from the spirit or essential character thereof as described heretofore. Therefore, the preferred embodiment described herein is illustrative and not restrictive, the scope of the invention being indicated by the appended claims and all variations which come within the meaning of the claims are intended to be embraced therein.

What is claimed is:

1. A musical tone signal generating apparatus, comprising:

(a) data generating means for generating musical tone waveform data in lapse of time, said musical tone waveform data consisting of first sampling data indicative of instantaneous amplitude values of a continuous musical tone waveform;

(b) first storing means for delaying said first sampling data outputted from said data generating means, so that said first storing means stores delayed first sampling data therein;

(c) acoustic converting means for converting an acoustic signal into an analog signal, wherein said acoustic signal indicates acoustics of an externally picked-up musical tone;

(d) analog-to-digital converting means for converting instantaneous values of said analog signal into a digital signal;

(e) second storing means for storing said digital signal as second sampling data indicative of said externally picked-up musical tone;

(f) multiplying means for multiplying each of said delayed first sampling data and each of said second sampling data together; and (g) combining means for combining output data of said multiplying means together to thereby form an output musical tone waveform, said output musical tone waveform being outputted from said combining means as output sampling data indicative of instantaneous amplitude values thereof.

2. A musical tone signal generating apparatus according to claim 1, further comprising:

(a) first means for generating an impulse response waveform signal indicative of an impulse response waveform of said externally picked-up musical tone; and (b) second means for converting said impulse response waveform signal into said acoustic signal.

3. A musical tone signal generating apparatus, comprising:

(a) first means for generating first sampling data indicative of instantaneous amplitude values of a first continuous musical tone waveform in lapse of time;

(b) first storing means for delaying said first sampling data outputted from said first means, so that said first storing means stores delayed first sampling data therein;

(c) second means for generating second sampling data indicative of instantaneous values of a second continuous musical tone waveform;

(d) second storing means for delaying said second sampling data outputted from said second means, so that said second storing means stores delayed second sampling data therein;

(e) multiplying means for multiplying each of said delayed first sampling data and each of said delayed second sampling data together; and (f) combining means for combining output data of said multiplying means together to thereby form an output musical tone waveform, said output musical tone waveform being outputted from said combining means as output sampling data indicative of instantaneous amplitude values thereof.

4. A musical tone signal generating apparatus according to claim 3 wherein said first sampling data change in a predetermined time direction and said second sampling data change in a reverse time direction.

5. A musical tone signal generating apparatus, comprising:

(a) first means for generating first sampling data indicative of instantaneous amplitude values of a continuous musical tone waveform in lapse of time;

(b) first storing means for delaying said first sampling data outputted from said first means, so that said first storing means stores delayed first sampling data therein.

(c) acoustic converting means for converting an acoustic signal into an analog signal, wherein said acoustic signal indicates acoustics of an externally picked-up musical tone;

(d) analog-to-digital converting means for converting instantaneous values of said analog signal into a digital signal, said digital signal being outputted as second sampling date;

(e) second storing means for delaying said second sampling data, so that said second storing means stores delayed second sampling data therein;

(f) multiplying means for multiplying each of said delayed first sampling data and each of said delayed second sampling data together; and (g) combining means for combining output data of said multiplying means together to thereby form an output musical tone waveform, said output musical tone waveform being outputted from said combining means as output sampling data indicative of instantaneous amplitude values thereof.

6. A musical tone signal generating apparatus, comprising:

(a) data generating means for generating musical tone waveform data in lapse of time, said musical tone waveform data consisting of first sampling data indicative of instantaneous amplitude values of a continuous musical tone waveform;

(b) storing means for delaying said first sampling data outputted from said data generating means, so that said storing means stores delayed first sampling data therein;

(c) waveform storing means for storing second sampling data indicative of instantaneous amplitude values of another musical tone waveform;

(d) multiplying means for multiplying each of said delayed first sampling data and each of said second sampling data together; and (e) combining means for combining output data of said multiplying means together to thereby form an output musical tone waveform, said output musical tone waveform being outputted from said combining means as output sampling data indicative of instantaneous amplitude values thereof.

7. A musical tone signal generating apparatus according to claim 6 further comprising selecting means for selecting a mode representing a designation of said second sampling data.

8. A musical tone signal generating apparatus, comprising:

(a) data generating means for generating musical tone waveform data in lapse of time, said musical tone waveform data consisting of first sampling data indicative of instantaneous amplitude values of a continuous musical tone waveform;

(b) storing means for delaying said first sampling data outputted from said data generating means, so that said storing means stores delayed first sampling data therein;

(c) waveform storing means for storing second sampling data indicative of instantaneous amplitude values of another musical tone waveform;

(d) operating means for operating each of said delayed first sampling data and each of said second sampling data together; and (e) tone forming means for forming a musical tone signal based on an output of said operating means.

9. A musical tone signal generating apparatus, comprising:

(a) first means for generating first sampling data indicative of instantaneous amplitude values of a first continuous musical tone waveform in lapse of time;

(b) second means for generating second sampling data indicative of instantaneous values of a second continuous musical tone waveform;

(c) operating means for operating delayed first sampling data and delayed second sampling data together; and (d) tone forming means for forming a musical tone signal based on an output of said operating means.

* * * * *